US012054226B1

(12) United States Patent
Mellas et al.

(10) Patent No.: US 12,054,226 B1
(45) Date of Patent: Aug. 6, 2024

(54) POWERED BIMINI TOP FRAME

(71) Applicant: Protomet Corporation, Oak Ridge, TN (US)

(72) Inventors: Nathan Mellas, Lenoir City, TN (US); Stewart Boyd, Knoxville, TN (US); William Reid, Knoxville, TN (US); William Caden Webb, Lenoir City, TN (US); Aaron Pierce, Knoxville, TN (US); Logan Atkins, Knoxville, TN (US)

(73) Assignee: Protomet Corporation, Oak Ridge, TN (US)

( * ) Notice: Subject to any disclaimer, the term of this patent is extended or adjusted under 35 U.S.C. 154(b) by 0 days.

(21) Appl. No.: 18/426,595

(22) Filed: Jan. 30, 2024

(51) Int. Cl.
*B63B 17/02* (2006.01)

(52) U.S. Cl.
CPC ..... *B63B 17/02* (2013.01)

(58) Field of Classification Search
CPC ..... B63B 17/02
USPC ..... 114/361, 382
See application file for complete search history.

(56) References Cited

U.S. PATENT DOCUMENTS

| | | | | |
|---|---|---|---|---|
| 9,096,291 | B2 | 8/2015 | Perosino | |
| 9,855,998 | B2 | 1/2018 | Perosino | |
| 10,597,119 | B1 * | 3/2020 | Lambert | B63B 17/02 |
| 11,472,512 | B1 * | 10/2022 | Ritchel | B63B 17/02 |
| 2019/0345721 | A1 * | 11/2019 | Mazzarelli | E04H 15/06 |

* cited by examiner

*Primary Examiner* — Anthony D Wiest
(74) *Attorney, Agent, or Firm* — Robinson IP Law, PLLC

(57) ABSTRACT

Various implementations include a frame for supporting a bimini top. The frame includes base, forward, and aft assemblies. The forward assembly has a first portion and a second portion rotatably coupled to a forward portion of the base assembly. The aft assembly has a first portion and a second portion. The first portion of the aft assembly is slidably coupled to an aft portion of the base assembly. The forward and aft assemblies are movable between collapsed and extended positions. The forward or aft assembly is operatively coupled to a drive assembly such that rotation of a pulley of the drive assembly relative to the base assembly causes the forward or aft assembly to move between the collapsed and extended positions. Movement of the forward assembly from the collapsed position to the extended position causes the aft assembly to move from the collapsed position to the extended position.

21 Claims, 6 Drawing Sheets

POWERED BIMINI TOP FRAME

BACKGROUND

Bimini tops are often installed on boats and other watercraft to provide shade or shelter to passengers of the watercraft. A traditional bimini top includes a canvas cover that is supported by a frame above passengers of the watercraft. These bimini tops may include a frame that may be at least partially collapsible such that the bimini top may be collapsed or stowed when the bimini top is not needed or in use, such as when shade or shelter is not required or during storage of the watercraft. In some instances, it may be required that the bimini be stowed during use of a watercraft, such as trailering of the watercraft at higher speeds.

While some existing bimini tops are foldable or collapsible when the bimini top is not in use, collapsing or stowing the tops may be time consuming, difficult, and cumbersome, often times requiring assistance from more than one user to complete the process of deploying and stowing the bimini top. Further, bimini tops may be located relatively high on a watercraft, such as on top of a tower or other structure of the watercraft. Deploying existing bimini tops may require standing on top of seats or other portions of the watercraft. It may be difficult to reach portions of the bimini top when moving the bimini top between stowed and deployed positions.

What is needed, therefore, is a bimini top frame that is actuated such that the bimini top is easily deployed and stowed on a vehicle such as a watercraft.

SUMMARY

Various implementations include a frame for supporting a bimini top. The frame includes a base assembly, a forward assembly, and an aft assembly. The base assembly has a longitudinal centerline, a forward portion, and an aft portion spaced apart from the forward portion along the longitudinal centerline. The base assembly further includes a drive assembly having a forward pulley, an aft pulley, and a belt extending between the forward pulley and aft pulley.

The forward assembly has a first portion and a second portion spaced apart from the first portion of the forward assembly. The second portion of the forward assembly is rotatably coupled to the forward portion of the base assembly. The forward assembly is rotatable between a collapsed position and an extended position. The first portion of the forward assembly is closer to the aft portion of the base assembly in the collapsed position than it is in the extended position.

The aft assembly has a first portion and a second portion spaced apart from the first portion of the aft assembly. The first portion of the aft assembly is slidably coupled to the aft portion of the base assembly. The aft assembly is slidable between a collapsed position and an extended position. The second portion of the aft assembly is closer to the forward portion of the base assembly in the collapsed position than it is in the extended position.

One of the forward assembly or the aft assembly is operatively coupled to the drive assembly such that rotation of the forward pulley relative to the base assembly causes the one of the forward assembly or the aft assembly to move between the collapsed position and the extended position. When the forward assembly is caused to move from the collapsed position to the extended position, the aft assembly is caused to move from the collapsed position to the extended position.

In some implementations, the frame further includes a latch movable between an engaged position and a disengaged position. In some implementations, the forward assembly and the aft assembly are prevented from moving between the collapsed position and extended position when the latch is in the engaged position and are allowed to move between the collapsed position and extended position when the latch is in the disengaged portion. In some implementations, the latch is electronically movable between the engaged position and disengaged position.

In some implementations, the forward assembly is a first forward assembly. In some implementations, the frame further includes a second forward assembly having a first portion and a second portion spaced apart from the first portion of the second forward assembly. In some implementations, the second portion of the second forward assembly is rotatably coupled to the first portion of the first forward assembly. In some implementations, the second forward assembly is rotatable between a collapsed position and an extended position. In some implementations, the first portion of the second forward assembly is closer to the aft portion of the base assembly in the collapsed position than it is in the extended position. In some implementations, when the first forward assembly is caused to move from the collapsed position to the extended position, the second forward assembly is caused to move from the collapsed position to the extended position.

In some implementations, the frame further includes a latch movable between an engaged position and a disengaged position. In some implementations, the first forward assembly, the second forward assembly, and the aft assembly are prevented from moving between the collapsed position and extended position when the latch is in the engaged position and are allowed to move between the collapsed position and extended position when the latch is in the disengaged portion. In some implementations, the latch is electronically movable between the engaged position and disengaged position. In some implementations, the latch is located at the rotatable coupling of the second portion of the second forward assembly and the first portion of the first forward assembly.

In some implementations, one of the forward pulley or the aft pulley is driven by a motor. In some implementations, the motor is operatively coupled to the one of the forward pulley or the aft pulley by a worm gear. In some implementations, both the forward portion and the aft portion are driven between the collapsed position and the extended position by the same motor.

In some implementations, the frame further includes one or more limit switches for preventing the motor from driving the one of the forward portion or the aft portion beyond the collapsed position or the extended position. In some implementations, each of the one or more limit switches detect a position of the aft assembly.

In some implementations, the forward pulley is operatively coupled to the second portion of the forward assembly such that rotation of the forward pulley relative to the base assembly causes the forward assembly to move between the collapsed position and the extended position. In some implementations, the first portion of the aft assembly is statically coupled to a portion of the belt such that rotation of the forward pulley relative to the base assembly causes the aft assembly to move between the collapsed position and the extended position. In some implementations, the aft assembly is sized and located relative to the belt such that the aft assembly and the first forward assembly each move from the collapsed position to the extended position at the same rate.

In some implementations, the forward assembly is a first forward assembly. In some implementations, the frame further includes a second forward assembly having a first portion and a second portion spaced apart from the first portion of the second forward assembly. In some implementations, the second portion of the second forward assembly is rotatably coupled to the first portion of the first forward assembly. In some implementations, the second forward assembly is rotatable between a collapsed position and an extended position. In some implementations, the first portion of the second forward assembly is closer to the aft portion of the base assembly in the collapsed position than it is in the extended position. In some implementations, when the first forward assembly is caused to move from the collapsed position to the extended position, the second forward assembly is caused to move from the collapsed position to the extended position.

In some implementations, the first forward assembly includes a first pulley adjacent the first portion of the first forward assembly, a second pulley adjacent the second portion of the first forward assembly, and a belt. In some implementations, the second pulley is static relative to the base assembly such that rotation of the forward pulley relative to the base assembly causes the first forward assembly to move between the collapsed position and the extended position.

In some implementations, the first pulley of the first forward assembly is operatively coupled to the second portion of the second forward assembly such that rotation of the first pulley relative to the first forward assembly causes the second forward assembly to move between the collapsed position and the extended position. In some implementations, the first pulley and the second pulley are sized such that the first forward assembly and the second forward assembly each move from the collapsed position to the extended position at the same rate.

In some implementations, the first forward assembly and the second forward assembly each rotate in an opposite rotational direction from each other. In some implementations, the aft assembly is sized and located relative to the belt such that the aft assembly and the first forward assembly each move from the collapsed position to the extended position at the same rate.

BRIEF DESCRIPTION OF DRAWINGS

Example features and implementations of the present disclosure are disclosed in the accompanying drawings. However, the present disclosure is not limited to the precise arrangements and instrumentalities shown. Similar elements in different implementations are designated using the same reference numerals.

FIG. 1A shows the frame in the collapsed position, FIG. 1B show the frame moving from the collapsed position toward the extended position, and FIG. 1C shows the frame in the extended position.

FIG. 2A shows the frame in the collapsed position, FIG. 2B shows the frame moving from the collapsed position toward the extended position, and FIG. 2C shows the frame in the extended position.

FIG. 6A shows the frame in the collapsed position, FIG. 6B show the frame moving from the collapsed position toward the extended position, and FIG. 6C shows the frame in the extended position.

DETAILED DESCRIPTION

Figure 1C:
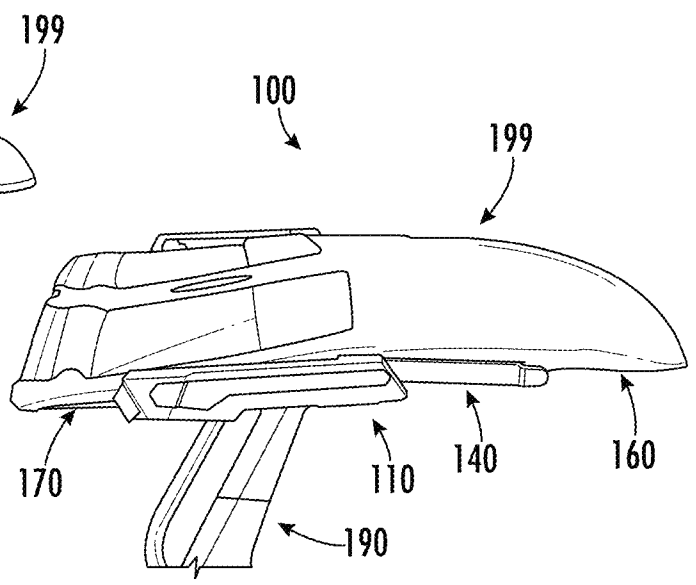
FIGS. 1A-1C are perspective views of a frame with a bimini top, according to one implementation.
Figure 1B:
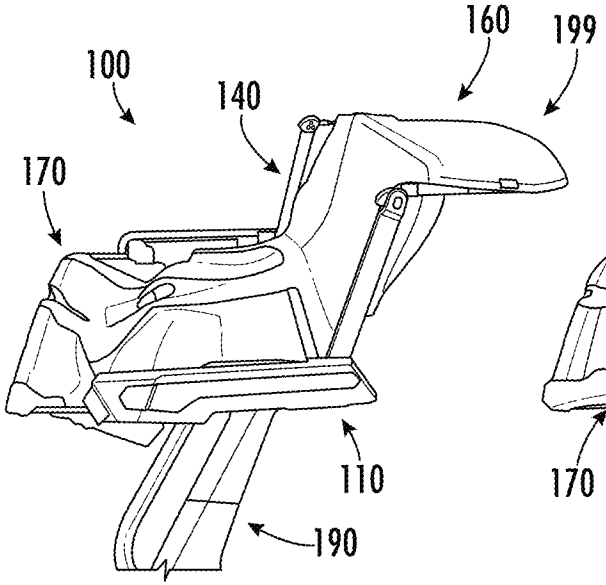

The devices, systems, and methods disclosed herein provide for a foldable or collapsible bimini top frame for a watercraft. The frame includes a base assembly, at least one forward assembly rotatably coupled to a forward portion of the base assembly, and an aft assembly slidably coupled to an aft portion of the base assembly. The base assembly includes a system of pulleys and belts to which the forward assembly and the aft assembly are both coupled. The operative coupling of the forward assembly and the aft assembly causes one assembly to move whenever the other assembly moves.

Each of the forward assembly and the aft assembly is movable between an extended position in which an attached bimini top is extended horizontally over at least a portion of the watercraft and a collapsed position in which the bimini top is folded adjacent the base assembly.

Various implementations include a frame for supporting a bimini top. The frame includes a base assembly, a forward assembly, and an aft assembly. The base assembly has a longitudinal centerline, a forward portion, and an aft portion spaced apart from the forward portion along the longitudinal centerline. The base assembly further includes a drive assembly having a forward pulley, an aft pulley, and a belt extending between the forward pulley and aft pulley.

The forward assembly has a first portion and a second portion spaced apart from the first portion of the forward assembly. The second portion of the forward assembly is rotatably coupled to the forward portion of the base assembly. The forward assembly is rotatable between a collapsed position and an extended position. The first portion of the forward assembly is closer to the aft portion of the base assembly in the collapsed position than it is in the extended position.

The aft assembly has a first portion and a second portion spaced apart from the first portion of the aft assembly. The first portion of the aft assembly is slidably coupled to the aft portion of the base assembly. The aft assembly is slidable between a collapsed position and an extended position. The second portion of the aft assembly is closer to the forward portion of the base assembly in the collapsed position than it is in the extended position. One of the forward assembly or the aft assembly is operatively coupled to the drive assembly such that rotation of the forward pulley relative to the base assembly causes the one of the forward assembly or the aft assembly to move between the collapsed position and the extended position. When the forward assembly is caused to move from the collapsed position to the extended position, the aft assembly is caused to move from the collapsed position to the extended position.

FIGS. 1A-5 show a frame 100 for supporting a bimini top 199, according to one implementation. The frame 100 includes a base assembly 110, a first forward assembly 140, a second forward assembly 160, and an aft assembly 170.

The base assembly 110 includes two portions configured to be coupled to a tower 190 or other raised portion of a watercraft. A first portion of the base assembly 110 is coupled to the starboard side of the tower 190 or other raised portion, and a second portion of the base assembly 110 is coupled to the port side of the tower 190 or other raised portion. Each of the two portions of the base assembly 110 includes a longitudinal centerline 116, a forward portion 112, and an aft portion 114 spaced apart from the forward portion 112 along the longitudinal centerline 116.

At least one of the two portions of the base assembly 110 further includes a drive assembly 120 having a forward pulley 122, an aft pulley 124, a tensioning pulley 128, and a belt 126 extending between the forward pulley 122 and aft pulley 124. The belt 126 further extends over a portion of the tensioning pulley 128 to tension the belt 126. The drive assembly 120 further includes a motor 130 having an output shaft 132, a worm gear 134 coupled to the output shaft 132 of the motor 130, and a drive gear 136 having teeth operatively engaged with teeth of the worm gear 134. Rotation of the output shaft 132 of the motor 130 causes rotation of the worm gear 134, which causes rotation of the drive gear 136. The drive gear 136 is rotatable relative to the base assembly 110 but is static relative to the aft pulley 124 such that rotation of the drive gear 136 causes rotation of the aft pulley 124. The rotation of the aft pulley 124 causes rotation of the belt 126, which causes the forward pulley 122 to rotate. The worm gear 134 provides holding or braking power to prevent the drive gear 136 from turning the worm gear 134. This prevents the frame 100 from moving from the desired position in use.

Although pulleys and belts are used throughout the description of the frames 100 shown in the figures, it should be understood that the term "pulley" as used herein can also refer to gears, sprockets, or any rotating or stationary object for guiding a belt therearound. As used herein, the term "belt" can also refer to a cable, chain, rope, cord, string, wire, or any other closed looped or open elongated object. Furthermore, it is contemplated that the term "belt" can refer to any flexible, semi-rigid, or rigid object capable of transferring movement of one "pulley" to another "pulley."

Although the drive gear 136 is directly coupled to the aft pulley 124, in some implementations, the drive gear is directly coupled to the forward pulley. In some implementations, the drive assembly does not include a worm gear. In some implementations, the motor directly drives the aft pulley or the forward pulley. In some implementations, the drive assembly includes any other type of braking or holding mechanism known in the art.

The motor 130 shown in FIGS. 1A-5 is a stepper motor, but in some implementations, the motor is any other kind of motor or actuator capable of causing rotation of the aft pulley or forward pulley. In some implementations, the drive assembly further includes a transmission system for changing the torque and rotational speed of the output shaft of the motor to the aft pulley or forward pulley.

Figure 6B:
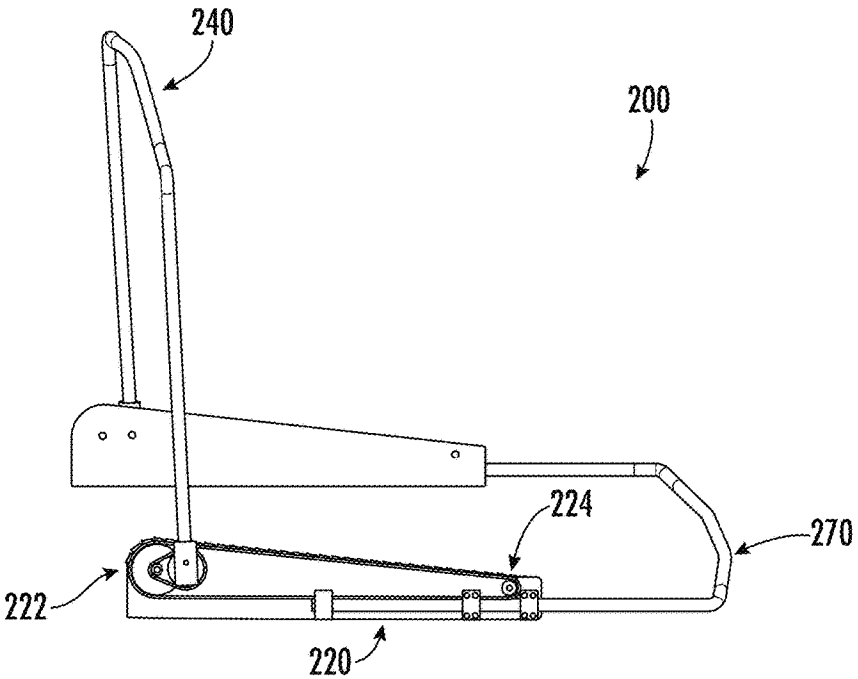
FIGS. 6A-6C are perspective views of a frame for supporting a bimini top, according to another implementation.
Figure 6A:
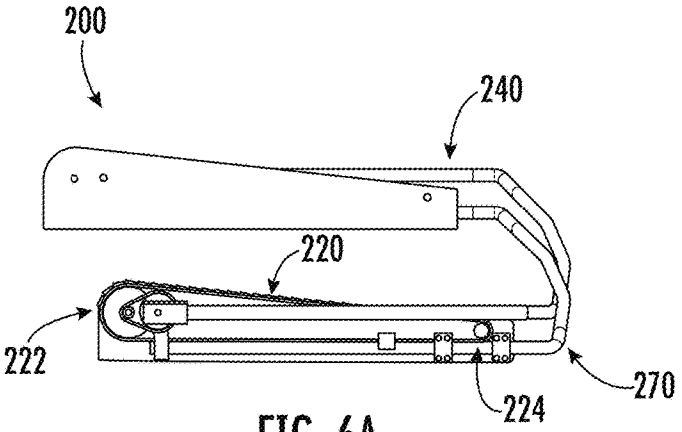
Figure 6C:
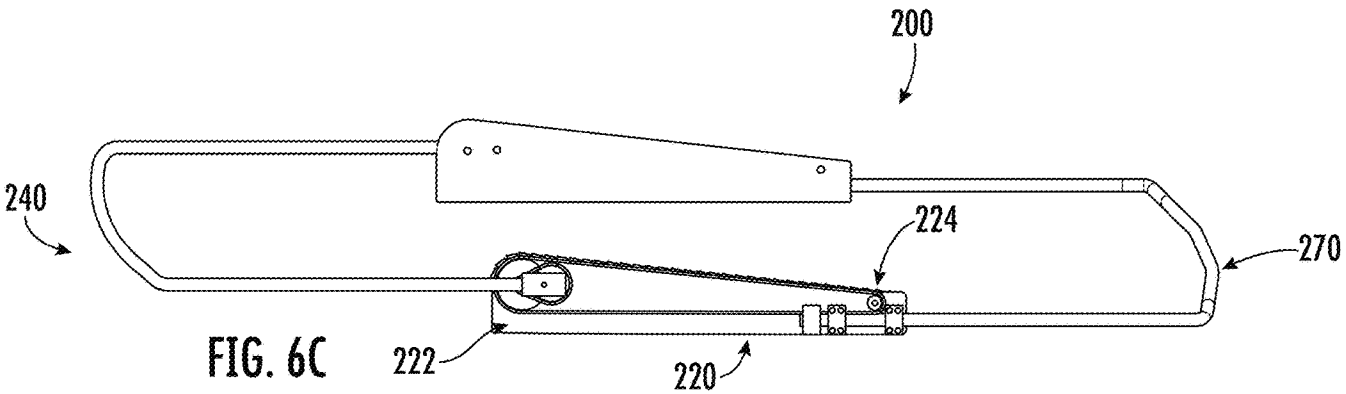

In some implementations, the frame does not include a motor or other actuator. In some implementations, the frame 200 is a manually operated frame 200, such as the frame 200 shown in FIGS. 6A-6C. As seen in FIGS. 6A-6C, the drive assembly 220 does not include a braking or holding mechanism such that manual movement of one of the forward pulley 222 (e.g., by moving the forward assembly 240) or the aft pulley 224 (e.g., by moving the aft assembly 270) causes movement of the other of the aft pulley 224 or the forward pulley 222. In some implementations, the drive system includes a handle (e.g., rotating or sliding) that causes manual rotation of the forward pulley or the aft pulley.

The first forward assembly 140 of the frame shown in FIGS. 1A-5 includes two arms. Each arm of the forward assembly 140 has a first portion 142 and a second portion 144 spaced apart from the first portion 142 of the first forward assembly 140. The first forward assembly 140 is rotatable between a collapsed position and an extended position. The first portion 142 of the first forward assembly 140 is closer to the aft portion 114 of the base assembly 110 in the collapsed position than it is in the extended position.

The second portion 144 of at least one arm of the first forward assembly 140 is statically coupled to the forward pulley 122 of the base assembly 110 such that the second portion 144 is rotatably coupled to the forward portion 112 of the base assembly 110. Thus, the rotation of the forward pulley 122 relative to the base assembly 110 causes rotation of the first forward assembly 140 about the second portion 144 of the first forward assembly 140 between the collapsed position and the extended position.

At least one arm of the first forward assembly 140 further includes a first pulley 152 adjacent the first portion 142 of the first forward assembly 140, a second pulley 154 adjacent the second portion 144 of the first forward assembly 140, and a belt 156. The first pulley 152 and second pulley 154 have the same effective diameter such that the first pulley 152 and second pulley 154 rotate at the same rotational speed or rate.

The second pulley 154 is static relative to the base assembly 110 such that, when the forward pulley 122 rotates to cause the first forward assembly 140 to rotate relative to the base assembly 110, the first forward assembly 140 also rotates relative to the second pulley 154. Thus, the rotation of the first forward assembly 140 causes the second pulley 154 to rotate relative to the first forward assembly 140.

Because the belt 156 of the first forward assembly 140 extends between the second pulley 154 and the first pulley 152, the relative rotation of the second pulley 154 and the first forward assembly 140 causes the first pulley 152 to also rotate relative to the first forward assembly 140. However, because the second pulley 154 does not rotate relative to the base assembly 110 and the first pulley 152 and second pulley 154 have the same rotational speed, the second pulley 154 also causes the first pulley 152 to remain non-rotational relative to the base assembly 110 as the first pulley 152 moves with the first portion 142 of the first forward assembly 140.

The second forward assembly 160 includes a U-shaped tubing. The second forward assembly 160 has a first portion 162 at the closed end of the U shape and a second portion 164 at the open end of the U shape and spaced apart from the first portion 162 of the second forward assembly 160. The second portion 164 of the second forward assembly 160 is rotatably coupled to the first portion 142 of the first forward assembly 140 by being statically coupled to the first pulley 152. Thus, rotation of the first pulley 152 relative to the first forward assembly 140 causes the second forward assembly 160 to also rotate relative to the first forward assembly 140 between a collapsed position and an extended position. The first portion 162 of the second forward assembly 160 is closer to the aft portion 114 of the base assembly 110 in the collapsed position than it is in the extended position. However, because the first pulley 152 is being driven by the second pulley 154, the rotational direction of the first forward assembly 140 relative to the base assembly 110 is opposite the rotational direction of the second forward assembly 160 relative to the first forward assembly 140. Thus, when the first forward assembly 140 and the second forward assembly 160 are moving between the extended position and the collapsed position, the second forward assembly 160, the first forward assembly 140, and the base assembly 110 form a Z-shaped profile.

Because the second forward assembly 160 is statically coupled to the first pulley 152, and because the first pulley 152 does not rotate relative to the base assembly 110, the second forward assembly 160 does not rotate relative to the base assembly 110. As the first forward assembly 140 moves from the collapsed position to the extended position, the second forward assembly 160 moves with the first portion 142 of the first forward assembly 140. However, a plane including the U-shaped second forward assembly 160 remains parallel to the longitudinal centerlines 116 of both portions of the base assembly 110 by not rotating relative to the base assembly 110.

As discussed above, the first pulley 152 and the second pulley 154 have the same effective diameter so the first forward assembly 140 and the second forward assembly 160 each move from the collapsed position to the extended position at the same rate.

Although the frame 110 shown in FIGS. 1A-5 includes a first forward assembly 140 and a second forward assembly 160, in some implementations, such as the frame 200 shown in FIGS. 6A-6C, the frame 200 only includes a single forward assembly 240. Furthermore, in some implementations, the frame can include three or more forward assemblies using the same or similar pulley and belt systems and configurations described herein with regard to the first forward assembly and the second forward assembly. In such implementations, each forward assembly would be rotatably coupled to a distal end of the previous forward assembly to create a wave-like shaped profile.

The aft assembly 170 includes a U-shaped tubing. The aft assembly 170 has a first portion 172 at the open end of the U shape and a second portion 174 at the closed end of the U shape and spaced apart from the first portion 172 of the aft assembly 170. The first portion 172 of the aft assembly 170 includes a belt clamp 176 that is coupled to a portion of the belt 126 of the drive assembly 120 of the base assembly 110 such that the aft assembly 170 is slidably coupled to the aft portion 114 of the base assembly 110. The base assembly 110 can also include linear bearings or guides to ensure that the aft assembly 170 slides along a straight axis relative to the longitudinal centerlines 116 of the base assembly 110. The aft assembly 170 is slidable between a collapsed position and an extended position. The second portion 174 of the aft assembly 170 is closer to the forward portion 112 of the base assembly 110 in the collapsed position than it is in the extended position.

Because the first portion 172 of the aft assembly 170 is statically coupled to the portion of the belt 126 via the belt clamp 176, rotation of the forward pulley 122 relative to the base assembly 110 causes the aft assembly 170 to move between the collapsed position and the extended position. Thus, as the first forward assembly 140 and the second forward assembly 160 are driven from their collapsed position to their extended position by the drive assembly 120, the aft assembly 170 is also driven from its collapsed position to its extended position by the drive assembly 120.

The size of the pulleys, belts, and position of the belt clamp are all selected such that the first forward assembly 140, the second forward assembly 160, and the aft assembly 170 all move from their collapsed positions to their extended positions at the same rate and reach their extended positions simultaneously. Similarly, the first forward assembly 140, the second forward assembly 160, and the aft assembly 170 all move from their extended positions to their collapsed positions at the same rate and reach their collapsed positions simultaneously.

For manually operated implementations of frames 200, such as in FIGS. 6A-6C, the movement of one of the forward assembly 240 or the aft assembly 270 from its extended position to its collapsed position causes rotation of the drive assembly 220, which causes the other of the aft assembly 270 or the forward assembly 240 to move from its extended position to its collapsed position. Similarly, the movement of one of the forward assembly 240 or the aft assembly 270) from its collapsed position to its extended position causes rotation of the drive assembly 220, which causes the other of the aft assembly 270 or the forward assembly 240 to move from its collapsed position to its extended position.

Figure 1A:
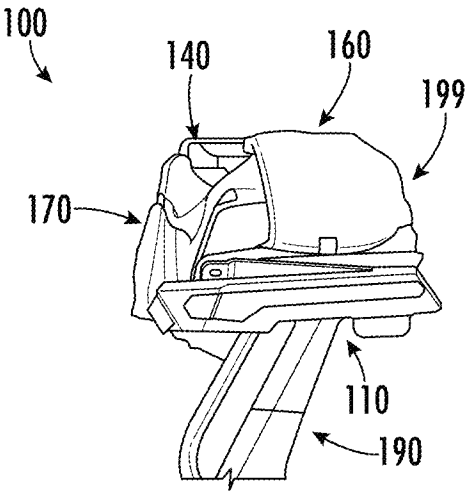
Figure 2C:
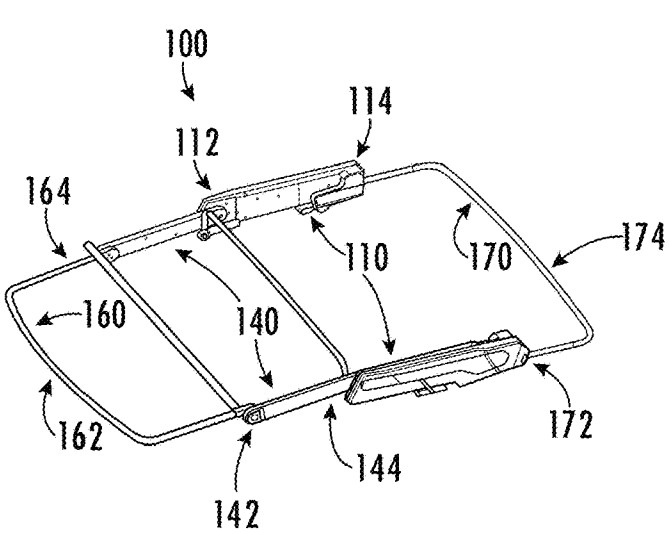
FIGS. 2A-2C are perspective views of the frame of FIGS. 1A-IC with the bimini top removed.
Figure 2B:
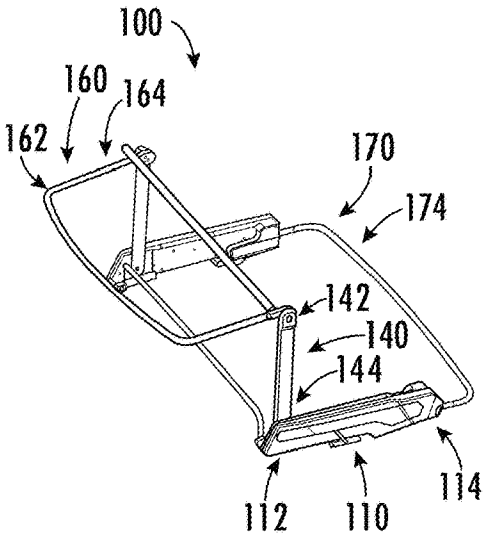
Figure 2A:
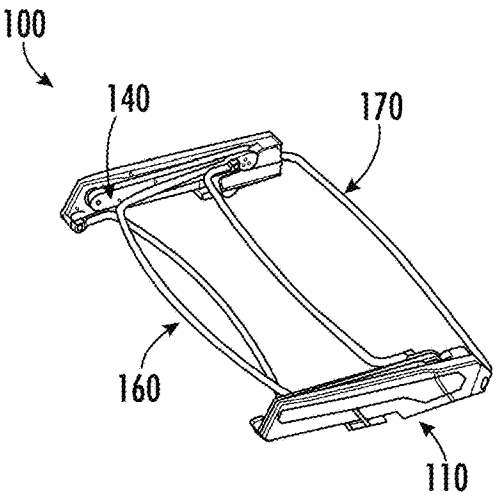
Figure 3A:
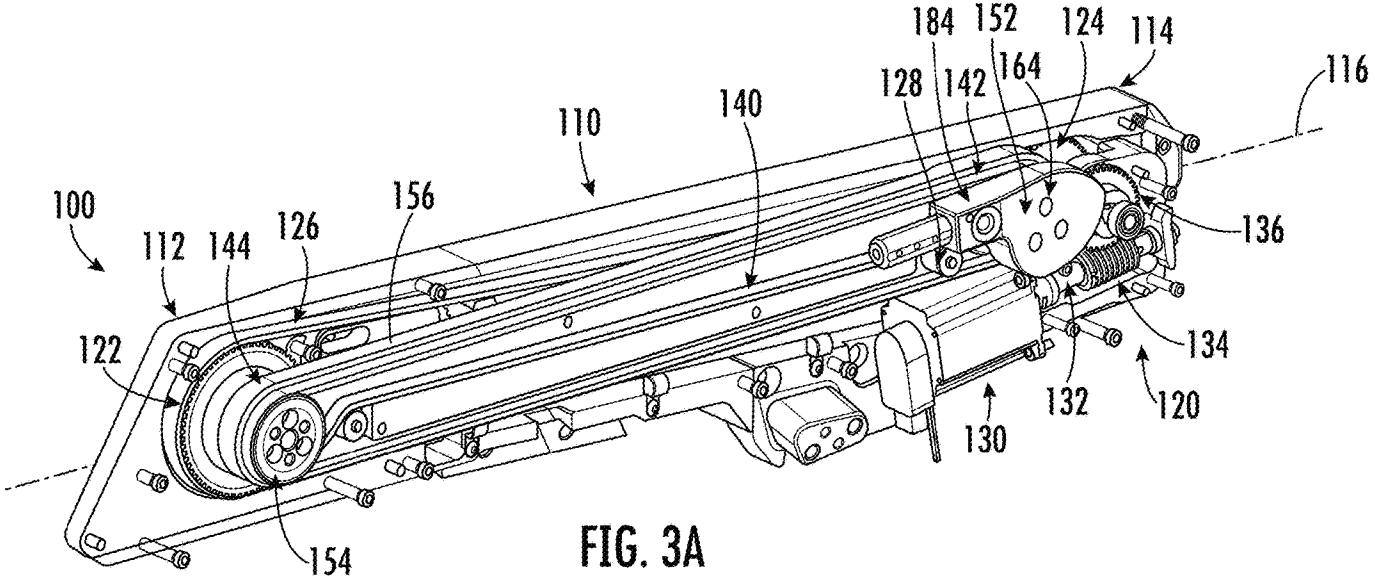
FIG. 3A is a perspective view of the frame of FIGS. 1A-1C in the collapsed position with a portion of the housing removed.
Figure 3B:
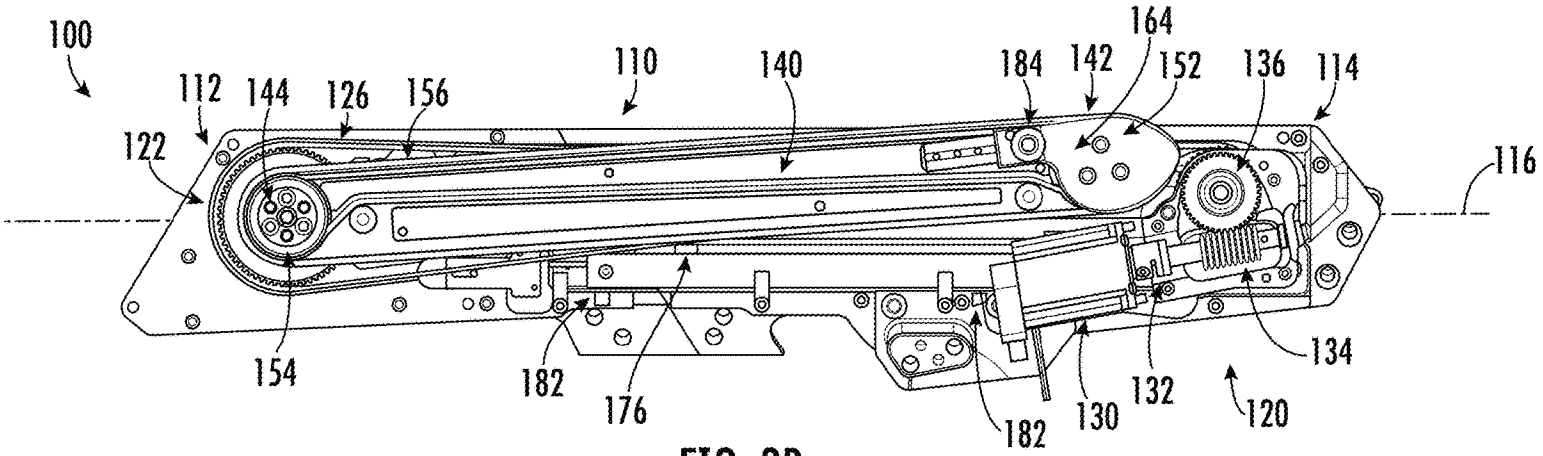
FIG. 3B is a side view of the frame of FIGS. 1A-1C in the collapsed position with a portion of the housing removed.
Figure 4A:
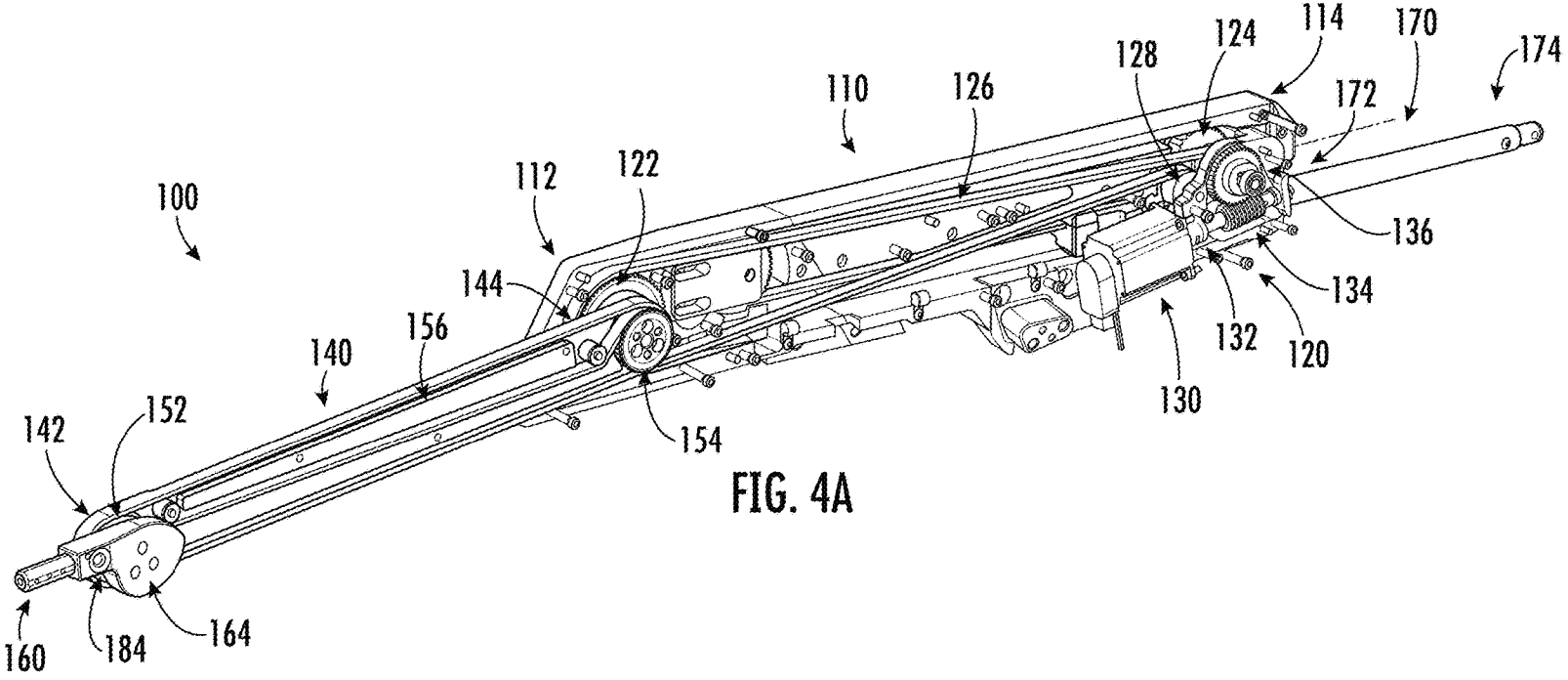
FIG. 4A is a perspective view of the frame of FIGS. 1A-1C in the extended position with a portion of the housing removed.
Figure 4B:
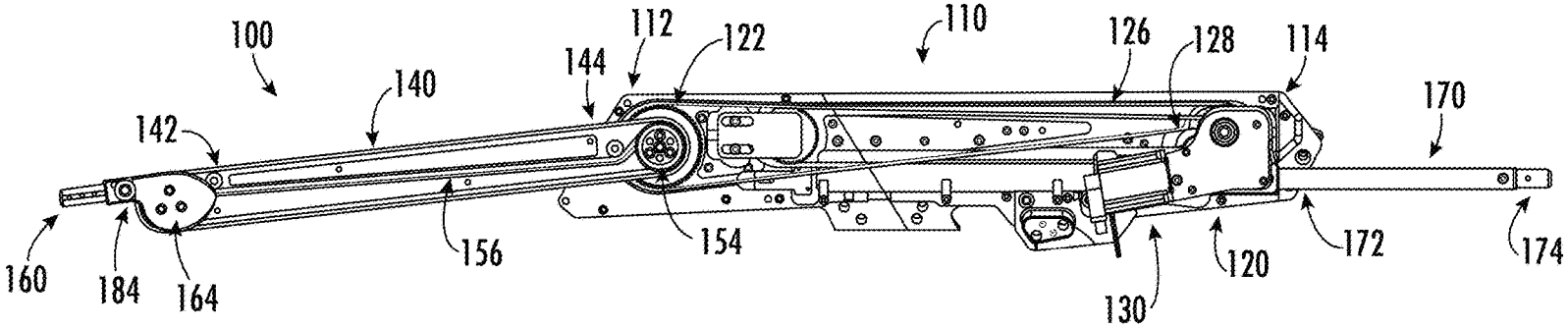
FIG. 4B is a side view of the frame of FIGS. 1A-1C in the extended position with a portion of the housing removed.
Figure 5:
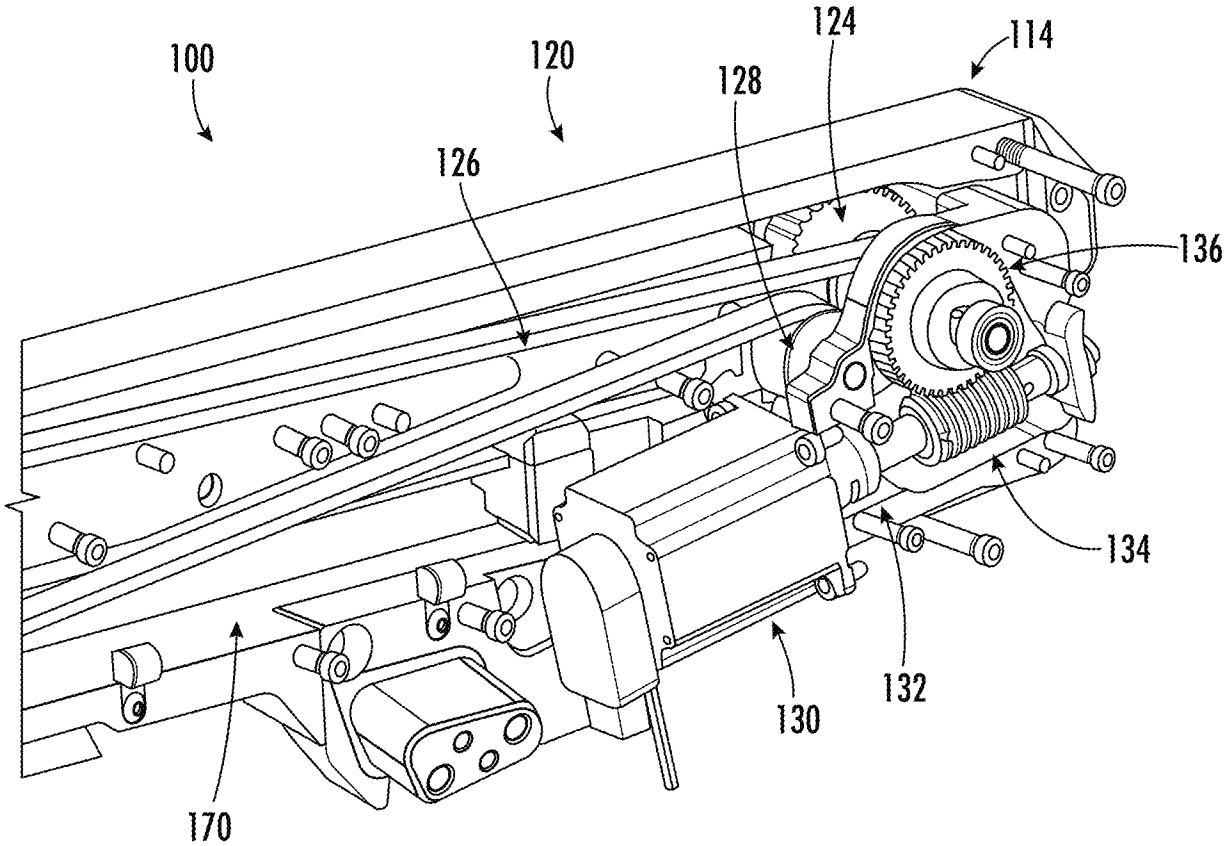
FIG. 5 is a detail perspective view of the drive assembly of the frame of FIGS. 1A-1C.

The frames 100, 200 shown in FIGS. 1A-6C are intended to support a bimini top 199, such as a bimini top 199 on a watercraft. As shown in FIGS. 1A-IC, the bimini top 199 is sized to extend tightly over the first forward assembly 140, the second forward assembly 160, and aft assembly 170 when in the extended position. When the first forward assembly 140, the second forward assembly 160, and aft assembly 170 move toward the collapsed position, the flexible bimini top 199 folds with the first forward assembly 140, the second forward assembly 160, and aft assembly 170.

For automatic implementations of frames 100 that include a motor 130 or actuator to move the drive assembly 120, such as the implementation shown in FIGS. 1A-5, the frame 100 can include one or more limit switches 182 for preventing the motor 130 or actuator from driving the first forward assembly 140, the second forward assembly 160, the aft assembly 170, or any combination thereof beyond the collapsed position or the extended position. For example, the frame 100 shown in FIGS. 1A-5 includes a limit switch 182 to detect the extended position of the aft assembly 170 and a limit switch 182 to detect the collapsed position of the aft assembly 170.

In use, once one of the limit switches 182 is closed, a signal is sent from the limit switch 182 to deactivate the motor 130. Although the frame 100 shown in FIGS. 1A-5 includes limit switches 182, in some implementations, the frame includes any other sensor known in the art for detecting the position of the first forward assembly, the second forward assembly, the aft assembly, and/or any other moving portion of the frame.

The frame 100 further includes a latch 184 that is movable between an engaged position and a disengaged position. The latch 184 shown in FIGS. 1A-5 is located at the rotatable coupling of the second portion 164 of the second forward assembly 160 and the first portion 142 of the first forward assembly 140. However, in some implementations, the latch can be located at any moving portion of the frame because the movement of each portion of the frame is operatively coupled to the movement of all other portions of the frame.

The latch 184 includes a pin that engages openings in both the second portion 164 of the second forward assembly 160 and the first portion 142 of the first forward assembly 140. The first forward assembly 140, the second forward assembly 160, and the aft assembly 170 are prevented from moving between the collapsed position and extended position when the latch 184 is in the engaged position and are allowed to move between the collapsed position and extended position when the latch 184 is in the disengaged portion.

Although the latch 184 shown in FIGS. 1A-5 is a manually operated latch, in some implementations, the latch is an electronically operated latch, as known in the art, having an electronic actuator for moving the latch between the engaged position and the disengaged position. In such implementations, the latch may be automatically engaged when the first forward assembly, the second forward assembly, and/or the aft assembly reach either their extended position, their collapsed position, or both. The position of the first forward assembly, the second forward assembly, and/or the aft assembly can be detected by one or more limit switches.

A number of example implementations are provided herein. However, it is understood that various modifications can be made without departing from the spirit and scope of the disclosure herein. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. Although the terms "comprising" and "including" have been used herein to describe various implementations, the terms "consisting essentially of" and "consisting of" can be used in place of "comprising" and "including" to provide for more specific implementations and are also disclosed.

Disclosed are materials, systems, devices, methods, compositions, and components that can be used for, can be used in conjunction with, can be used in preparation for, or are products of the disclosed methods, systems, and devices. These and other components are disclosed herein, and it is understood that when combinations, subsets, interactions, groups, etc. of these components are disclosed that while specific reference of each various individual and collective combinations and permutations of these components may not be explicitly disclosed, each is specifically contemplated and described herein. For example, if a device is disclosed and discussed each and every combination and permutation of the device are disclosed herein, and the modifications that are possible are specifically contemplated unless specifically indicated to the contrary. Likewise, any subset or combination of these is also specifically contemplated and disclosed. This concept applies to all aspects of this disclosure including, but not limited to, steps in methods using the disclosed systems or devices. Thus, if there are a variety of additional steps that can be performed, it is understood that each of these additional steps can be performed with any specific method steps or combination of method steps of the disclosed methods, and that each such combination or subset of combinations is specifically contemplated and should be considered disclosed.

What is claimed is:

1. A frame for supporting a bimini top, the frame comprising:

a base assembly having a longitudinal centerline, a forward portion, and an aft portion spaced apart from the forward portion along the longitudinal centerline, wherein the base assembly further includes a drive assembly having a forward pulley, an aft pulley, and a belt extending between the forward pulley and aft pulley;

a forward assembly having a first portion and a second portion spaced apart from the first portion of the forward assembly, wherein the second portion of the forward assembly is rotatably coupled to the forward portion of the base assembly, wherein the forward assembly is rotatable between a collapsed position and an extended position, wherein the first portion of the forward assembly is closer to the aft portion of the base assembly in the collapsed position than it is in the extended position; and an aft assembly having a first portion and a second portion spaced apart from the first portion of the aft assembly, wherein the first portion of the aft assembly is slidably coupled to the aft portion of the base assembly, wherein the aft assembly is slidable between a collapsed position and an extended position, wherein the second portion of the aft assembly is closer to the forward portion of the base assembly in the collapsed position than it is in the extended position, wherein one of the forward assembly or the aft assembly is operatively coupled to the drive assembly such that rotation of the forward pulley relative to the base assembly causes the one of the forward assembly or the aft assembly to move between the collapsed position and the extended position, and wherein, when the forward assembly is caused to move from the collapsed position to the extended position, the aft assembly is caused to move from the collapsed position to the extended position.

2. The frame of claim 1, further comprising a latch movable between an engaged position and a disengaged position, wherein the forward assembly and the aft assembly are prevented from moving between the collapsed position and extended position when the latch is in the engaged position and are allowed to move between the collapsed position and extended position when the latch is in the disengaged portion.

3. The frame of claim 2, wherein the latch is electronically movable between the engaged position and disengaged position.

4. The frame of claim 1, wherein the forward assembly is a first forward assembly, the frame further comprising a second forward assembly having a first portion and a second portion spaced apart from the first portion of the second forward assembly, wherein the second portion of the second forward assembly is rotatably coupled to the first portion of the first forward assembly, wherein the second forward assembly is rotatable between a collapsed position and an extended position, wherein the first portion of the second forward assembly is closer to the aft portion of the base assembly in the collapsed position than it is in the extended position, and wherein, when the first forward assembly is caused to move from the collapsed position to the extended position, the second forward assembly is caused to move from the collapsed position to the extended position.

5. The frame of claim 4, further comprising a latch movable between an engaged position and a disengaged position, wherein the first forward assembly, the second forward assembly, and the aft assembly are prevented from moving between the collapsed position and extended position when the latch is in the engaged position and are allowed to move between the collapsed position and extended position when the latch is in the disengaged portion.

6. The frame of claim 5, wherein the latch is electronically movable between the engaged position and disengaged position.

7. The frame of claim 5, wherein the latch is located at the rotatable coupling of the second portion of the second forward assembly and the first portion of the first forward assembly.

8. The frame of claim 1, wherein one of the forward pulley or the aft pulley is driven by a motor.

9. The frame of claim 8, wherein the motor is operatively coupled to the one of the forward pulley or the aft pulley by a worm gear.

10. The frame of claim 8, wherein both the forward portion and the aft portion are driven between the collapsed position and the extended position by the same motor.

11. The frame of claim 8, further including one or more limit switches for preventing the motor from driving the one of the forward portion or the aft portion beyond the collapsed position or the extended position.

12. The frame of claim 11, wherein each of the one or more limit switches detect a position of the aft assembly.

13. The frame of claim 1, wherein the forward pulley is operatively coupled to the second portion of the forward assembly such that rotation of the forward pulley relative to the base assembly causes the forward assembly to move between the collapsed position and the extended position.

14. The frame of claim 13, wherein the first portion of the aft assembly is statically coupled to a portion of the belt such that rotation of the forward pulley relative to the base assembly causes the aft assembly to move between the collapsed position and the extended position.

15. The frame of claim 14, wherein the aft assembly is sized and located relative to the belt such that the aft assembly and the first forward assembly each move from the collapsed position to the extended position at the same rate.

16. The frame of claim 13, wherein the forward assembly is a first forward assembly, the frame further comprising a second forward assembly having a first portion and a second portion spaced apart from the first portion of the second forward assembly, wherein the second portion of the second forward assembly is rotatably coupled to the first portion of the first forward assembly, wherein the second forward assembly is rotatable between a collapsed position and an extended position, wherein the first portion of the second forward assembly is closer to the aft portion of the base assembly in the collapsed position than it is in the extended position, and wherein, when the first forward assembly is caused to move from the collapsed position to the extended position, the second forward assembly is caused to move from the collapsed position to the extended position.

17. The frame of claim 16, wherein the first forward assembly includes a first pulley adjacent the first portion of the first forward assembly, a second pulley adjacent the second portion of the first forward assembly, and a belt, wherein the second pulley is static relative to the base assembly such that rotation of the forward pulley relative to the base assembly causes the first forward assembly to move between the collapsed position and the extended position.

18. The frame of claim 17, wherein the first pulley of the first forward assembly is operatively coupled to the second portion of the second forward assembly such that rotation of the first pulley relative to the first forward assembly causes the second forward assembly to move between the collapsed position and the extended position.

19. The frame of claim 18, wherein the first pulley and the second pulley are sized such that the first forward assembly and the second forward assembly each move from the collapsed position to the extended position at the same rate.

20. The frame of claim 19, wherein the first forward assembly and the second forward assembly each rotate in an opposite rotational direction from each other.

21. The frame of claim 19, wherein the aft assembly is sized and located relative to the belt such that the aft assembly and the first forward assembly each move from the collapsed position to the extended position at the same rate.

* * * * *